United States Patent [19]

Kunde et al.

[11] Patent Number: 4,563,884

[45] Date of Patent: Jan. 14, 1986

[54] CIRCULAR KNITTING MACHINE FOR THE PRODUCTION OF GOODS WITH ENMESHED FIBERS

[75] Inventors: Klaus Kunde, Kohlberg; Helmut Grimm, Neckartailfingen; Lorenz Becker, Aichtal, all of Fed. Rep. of Germany

[73] Assignee: Sulzer Morat GmbH, Fed. Rep. of Germany

[21] Appl. No.: 564,413

[22] Filed: Dec. 22, 1983

[30] Foreign Application Priority Data

Dec. 24, 1982 [DE] Fed. Rep. of Germany ..... 3247957

[51] Int. Cl.[4] ..... D04B 9/14; D04B 35/32

[52] U.S. Cl. ..... 66/93; 66/168

[58] Field of Search ..... 19/107; 66/9 B, 168

[56] References Cited

U.S. PATENT DOCUMENTS

| | | | |
|---|---|---|---|
| 3,014,355 | 12/1961 | Hill | 66/9 B |
| 3,968,662 | 7/1976 | Kunak et al. | 66/9 B |
| 3,999,405 | 12/1976 | Abler et al. | 66/9 B |
| 4,438,549 | 3/1984 | Silander | 19/107 |

*Primary Examiner*—Wm. Carter Reynolds

[57] ABSTRACT

A circular knitting machine for the production of high-pile fabrics having combed-in fibres is disclosed herein. The knitting machine has a needle cylinder carrying knitting tools, at least one carding means for combing fibers into the knitting tools, an exhaust hood disposed above the needle cylinder and intended for the removal of loose fibres and at least one component disposed within and/or outside of the exhaust hood and fastenable thereto by means of at least one strut, to substantially eliminate the danger of any accumulation of loose fibres on the strut. The strut has an airfoil configuration.

7 Claims, 7 Drawing Figures

CIRCULAR KNITTING MACHINE FOR THE PRODUCTION OF GOODS WITH ENMESHED FIBERS

BACKGROUND OF THE INVENTION

The invention relates to a circular knitting machine for the production of goods with enmeshed fibers, having a needle cylinder providing support for knitting tools, at least one comb for combing the fibers into the needles, an exhaust hood surmounting the needle cylinder and serving for the aspiration and removal of loose fibers, and at least one component disposed inside or outside of the exhaust hood and fastened to the latter by means of at least one strut.

In known circular knitting machines of this kind (U.S. Pat. Nos. 3,014,355 and 3,968,662, and German OS No. 2,307,111), the component consists of a base plate largely covering over the bottom intake opening, a second exhaust hood disposed inside of and below a first air exhaust hood for the aspiration of loose fibers from the surface of the knit goods and from within the needle cylinder, or it consists of air guiding means which are intended both to improve the enmeshing action and to reduce fiber losses. The component is fastened to the exhaust hood in each case by means of struts. These constitute obstacles in the exhaust stream, on which loose fibers rapidly accumulate, form clumps, and reduce the airflow cross section, and this requires frequent maintenance operations. This effect is worsened by the amounts of oil and water (needle oil, condensation water or the like) produced in the operation of the circular knitting machine, which greatly promote the adherence of the loose fibers to the struts. Aside from the rapid contamination of the struts the above-mentioned, known exhaust hoods are characterized by a low aspirating efficiency or else by a high consumption of energy.

For the avoidance of this disadvantage in another known circular knitting machine (German OS No. 2,633,912), an air guiding means disposed below or within the exhaust hood is fastened to a shaft which is disposed coaxially in the needle cylinder and joined to that latter, so that it revolves with the needle cylinder. As a result of this arrangement, the knit goods have to be cut open lengthwise, and this is frequently undesirable.

Furthermore, in practice nowadays, only simple, truncated cone shaped or conical exhaust hoods are used. One consequence of this is low exhaust efficiencies, because the truncated cone shaped or conical exhaust hoods have their largest cross section, and hence their lowest aspirating power, at the point where the loose fibers are to be picked up and carried away.

Due to the low efficiency of the known exhaust apparatus, it is furthermore necessary to provide at each knitting station at least one air jet for the purpose of holding the fibers securely in the hooks of the knitting needles during the combing-in action and before the looping action. These air jets, in conjunction with the air movements produced by the needle cylinder rotation, result in considerable turbulence and air eddies which still further reduce the efficiency of the exhaust apparatus and often blow fibers which have already been inserted into the knitting needles back out of them before they have been bound into the basic goods, and this increases the fiber losses.

It is the object of the invention to increase the air-moving efficiency of the circular knitting machine described in the beginning, while reducing power consumption and fiber loss, and particularly to substantially eliminate the danger of the accumulation of loose fibers on the struts.

BRIEF SUMMARY OF THE INVENTION

For the attainment of the stated object, the circular knitting machine of the kind specified above is characterized in accordance with the invention by providing the strut with an airfoil configuration.

ADVANTAGES OF THE INVENTION

The invention offers the surprising advantage that the formation of undesirable fiber accumulations can be prevented merely by the use of struts having an airfoil configuration. This is attributed to the fact that an airfoil has surfaces on either side of the chord line or mean camber line, which are not symmetrical, resulting in different velocities of flow along the two surfaces and hence making it virtually impossible for fibers to collect in the critical area of the leading edge of the airfoil, without the need for feeding any additional air blast to the leading edge. In this manner, a turbulence-free and eddy-free, as well as energy-saving aspiration of air is made possible.

BRIEF DESCRIPTION OF THE DRAWING

The invention will be described below by means of an embodiment in conjunction with the appended drawing wherein.

DESCRIPTION OF A PREFERRED EMBODIMENT

Figure 1:
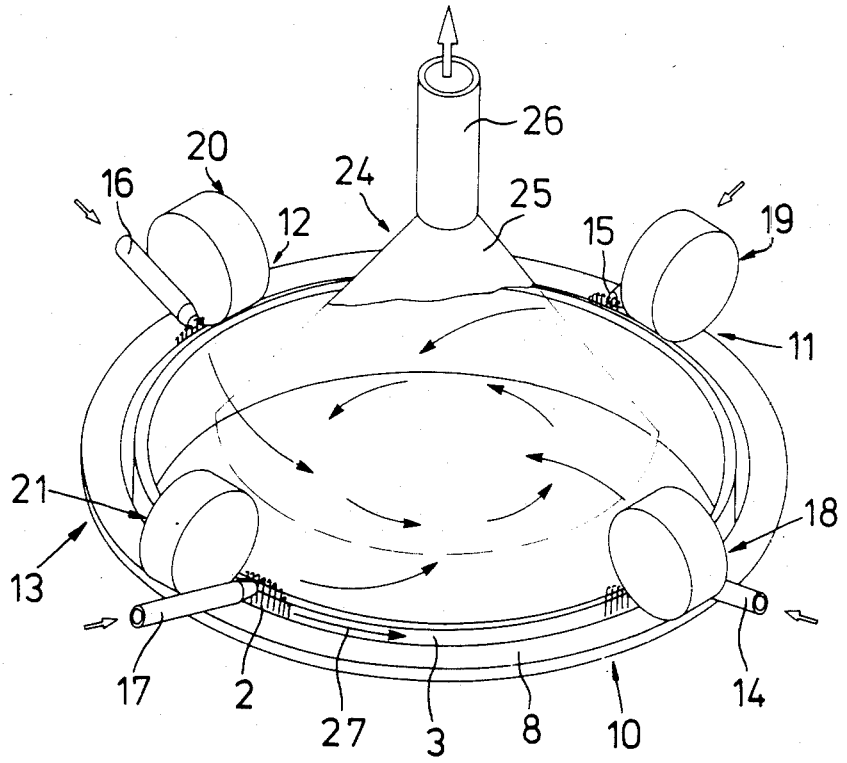
FIG. 1 is a diagrammatic perspective representation of a circular knitting machine for the production of goods with enmeshed fibers.

As seen in FIG. 1, a circular knitting machine for the production of goods 1 having enmeshed fibers has a needle cylinder 3 equipped with needles 2 and a sinker ring 5 equipped with sinkers 4, both being mounted for rotation in a machine frame. The needles 2 and sinkers 4 are operated in a conventional manner by cam parts 7 fastened to a cam cylinder 6 and cam parts 9 fastened to a sinker cylinder 8. At the periphery of the needle cylinder 3, there are disposed a plurality of knitting stations and knitting systems 10 to 13 in a spaced-apart relationship, each of which can contain a patterning means whereby the needles 2 can be selected to knit or miss-knit according to pattern. Furthermore, an air jet 14 to 17 is associated with each knitting system for the purpose of aligning the fibers.

On each knitting system 10 to 13, there is furthermore provided a carding device 18 to 21 which serves for feeding the fibers of a particular kind, e.g. a particular color, to the needles selected to knit. Each carding device consists, for example, of a tambour 22 having a card clothing to which fibers are fed in the form of a sliver by means of a pair of feed rolls, and of a pickup or enmeshing roll 23 having a card clothing, by means of which the fibers picked up from tambour 22 are presented to the needles selected to knit.

Above the needle cylinder 3 there is disposed an exhaust means 24 which has a truncated cone shaped exhaust hood 25 for sucking up loose fibers. The hood 25 is connected at its top to an exhaust duct 26 which leads to a vacuum source which is not represented.

The direction of rotation of the needle cylinder is indicated by the arrow 27. The air flow into the air jets 14 to 17, which are connected to compressed air sources not indicated, and which are below the exhaust hood 25, is indicated by the other arrows.

Circular knitting machines of the kind described are known, for example, from U.S. Pat. Nos. 3,014,355 and 3,968,662, and from German OS Nos. 2,307,111 and 2,633,912, which are expressly cited herein.

In accordance with the invention, a component in the form of an air guiding means 29, made of conical shape like the exhaust hood 25, extends at least partially into the bottom of the exhaust hood 25, and has a diameter which diminishes from the bottom up. The air guiding means 29 is disposed substantially coaxial with the exhaust hood 25A and inside of the latter such that between the two there is formed a substantially conical exhaust passage 30 which extends approximately from the upper edge of the needle cylinder to the exhaust pipe 26 and has a substantially constant width b all around. By the configuration of the exhaust passage 30, the suction efficiency is substantially increased, and the vacuum aperture is reduced and limited to an annular area close to the top edge of the needle cylinder.

Figure 2:
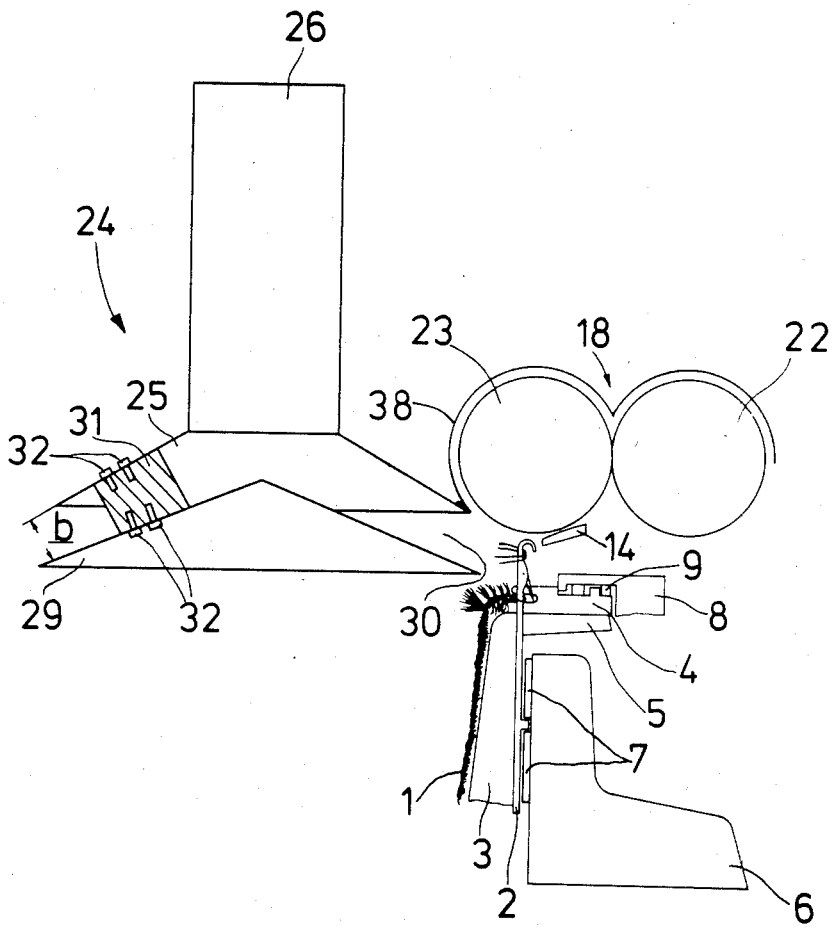
FIG. 2 is a diagrammatic cross section taken through the circular knitting machine of FIG. 1 equipped with an exhaust hood in accordance with the invention.
Figure 3:
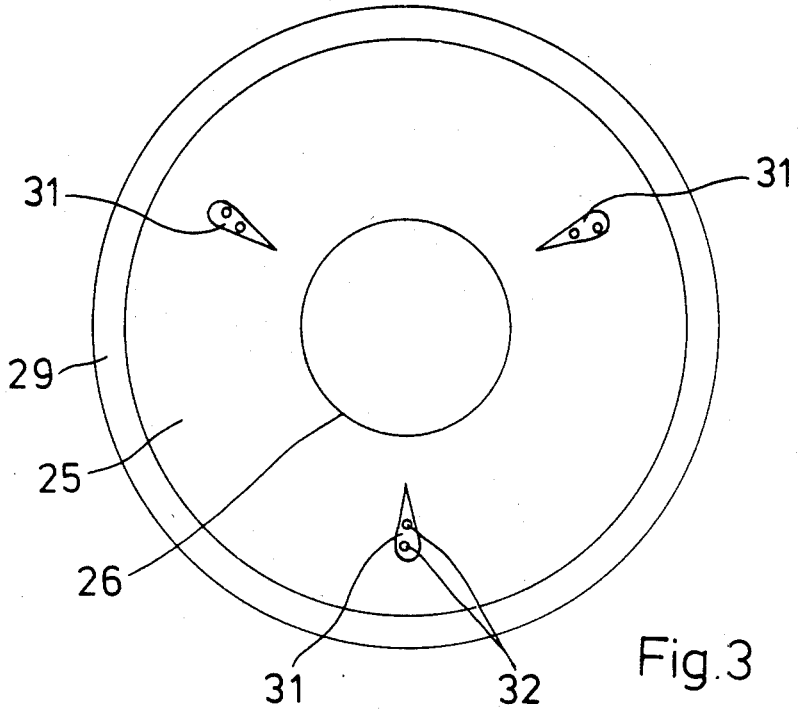
FIG. 3 is a top plan view of the exhaust hood of FIG. 2.
Figure 4:
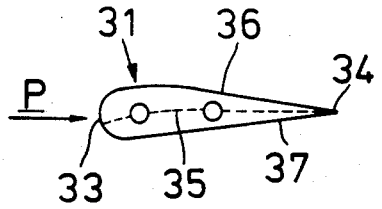
FIGS. 4 and 5 are top and side views of a strut of the exhaust hood of FIG. 2 on an enlarged scale.

The air guiding means 29 is fastened to the exhaust hood 25 by means of at least one strut 31 and screws 32 driven into the latter. As seen in FIGS. 3 and 4, the strut 31 has an airfoil configuration and consequently a rounded leading edge 33 and a slender rear portion terminating in a sharp trailing edge 34, the thickness measured at right angles to the wind direction (arrow P) being relatively small in relation to the width measured parallel to the relative wind direction. Moreover, the strut 31 has faces 36 and 37 asymmetrically formed on either side of the chord line or mean camber line 35 indicated by the broken line in FIG. 4, face 36 having a greater length measured in the air-flow direction than the other face 37. This results in different friction ratios and velocities of flow on the sides of the chord line 35, bringing it about that fibers flowing in the direction of the arrow P do not adhere in the area of the leading edge to cause undesired clumping. If the airfoil dimensions are suitably chosen, desirable aerodynamic flow conditions result, such that, even in the presence of unavoidable residues of lubricating oil or condensed moisture, no fibers collect on the struts. If the fibers used are not too long, it is possible, without increasing the power of the aspiration source connected with the aspiration pipe 26, even to omit the air jets 14 to 17 shown in FIGS. 1 and 2, without resulting in problems with the enmeshing and/or aspiration of the fibers.

Figure 5:
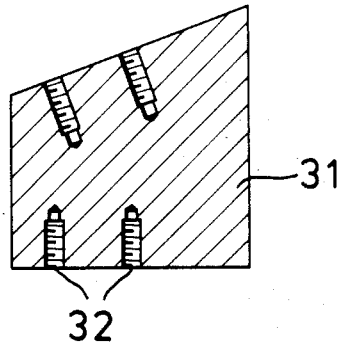
Figure 6:
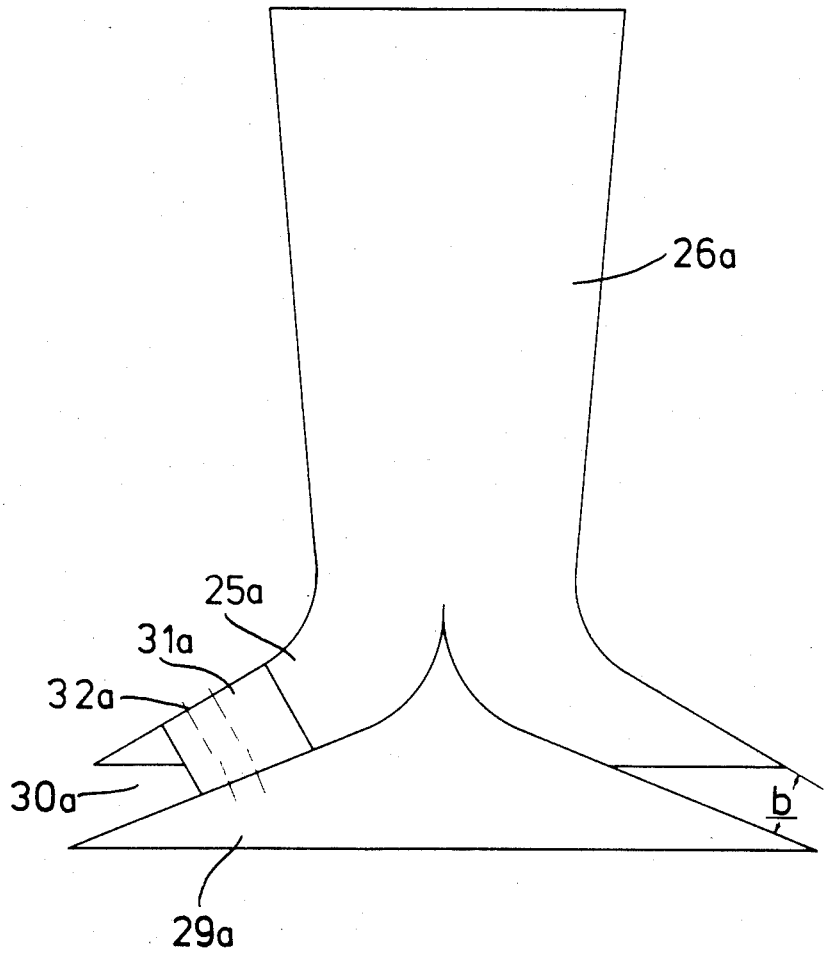
FIG. 6 is a diagrammatic cross section through an exhaust hood in accordance with another embodiment of the invention.

The embodiment represented in FIG. 6, in which identical parts are provided with the same reference numbers, differs from that of FIGS. 3 to 5 in that both the width b of the suction passage 30A and the cross section of the suction duct 26A increases from the bottom up. The velocity of flow is thereby substantially increased both in the area of the top edge of the needle cylinder and in the front section of the exhaust passage 30A in which the struts 31 are disposed.

The above-described configuration of the exhaust means additionally offers the advantage that the outer edges of the suction hood 25A and of the air guiding means 29A can be brought close up against the combing means 18 and the top edge of the needle cylinder, respectively. Turbulence and air eddies can thus be prevented, even if the air jets 14 to 17 are present. It is especially advantageous to connect the outer end of the exhaust hood 25 to the bottom end of a lateral shroud 38 (FIG. 2) of the combing means 18, such that the space in back of the needles is completely covered by the exhaust passage 30, so that loose fibers can flow virtually tangentially into the exhaust passage 30, while the fibers combed into the needles are already so well aligned by the exhaust pressure that the pressure of the air jets 14 to 17 can at least be greatly reduced.

Figure 7:
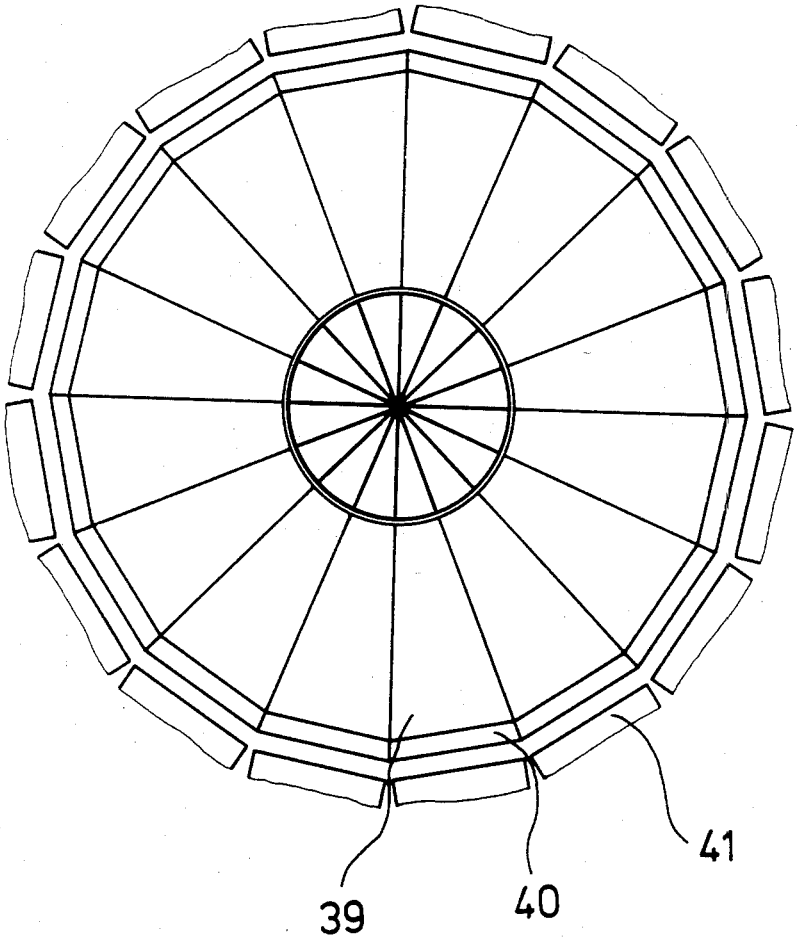
FIG. 7 shows a top plan view of an exhaust hood according to a third embodiment.

In the case of the embodiment represented in FIG. 7, both the exhaust hood and the air guiding element are composed of a plurality of substantially trapezoidal, planar segments 39 and 40 whose upper ends are adapted to the shape of an exhaust duct for connection thereto and therefore can be curved. The number of the segments 39, 40, can best correspond to the number of fiber enmeshing zones 41. The bottom ends of the segments are preferably of rectilinear shape and disposed parallel to the fiber enmeshing zones 41. In this manner a constant distance between the enmeshing zones 41 and the entrances of the exhaust passages formed by the segments 39 and 40 is achieved over the entire length of the enmeshing zones 41, and this can have a desirable effect on the conditions of flow.

The invention is not restricted to the embodiments described herein, which can be varied in many ways. This is true especially of the configuration of the exhaust hood, the air guiding element and the exhaust duct, which can be adapted to the conditions desired in any particular case. The shape of the struts 31 is not restricted to the example represented. Particularly good results can be achieved, for example, with laminar flow configurations, which are distinguished by an especially great distance between the point of greatest thickness and the leading edge. Lastly, the number of struts may be as desired, although a very small number of struts is preferred.

With regard to the external surface of the struts, those materials and surface roughnesses are preferred which are least conducive to the adhesion of fibers. The width b of the exhaust passages can be selected according to the number of systems. In particular, it may be desirable in the case of a large number of systems to obtain a greater flow cross section and to adapt the capacity of the exhaust source to the particular circumstances.

We claim:

1. Circular knitting machine for the production of goods with enmeshed fibers, having a needle cylinder carrying knitting tools, having at least one card comb means for combing fibers into the knitting tools, having an exhaust hood disposed above the needle cylinder and intended for the removal of loose fibers, and having at least one component disposed at least partially within of the exhaust hood and fastenable thereto by means of at least one strut, characterized in that the strut (31) has an airfoil configuration.

2. Circular knitting machine of claim 1, characterized in that the component consists of a hood-like air guiding means (29) extending at least partially into the exhaust hood (25) and forming with the exhaust hood (25) an exhaust passage (30).

3. Circular knitting machine of claim 1 or 2, characterized in that the airfoil configuration is a laminar configuration.

4. Circular knitting machine of claim 2, characterized in that the exhaust hood (25) has a truncated cone shape and the air guiding means (29) have a conical configuration.

5. Circular knitting machine of claim 2, characterized in that the exhaust hood (25) and the air guiding means (29) are disposed coaxially with one another.

6. Circular knitting machine of claim 2, characterized in that the exhaust passage (30) has a width (b) which increases in the direction of flow.

7. Circular knitting machine of any one of claims 1, 2, 5 or 6, characterized in that the upper end of the exhaust hood (25) is connected to an exhaust duct (26) whose cross section increases in the direction of flow.

* * * * *